US011626678B2

(12) United States Patent
Ito et al.

(10) Patent No.: US 11,626,678 B2
(45) Date of Patent: Apr. 11, 2023

(54) CONNECTOR FOR HIGH-SPEED TRANSMISSION AND METHOD FOR FIXING SOLDER TO FORK PORTION OF CONNECTOR FOR HIGH-SPEED TRANSMISSION

(71) Applicant: Yamaichi Electronics Co., Ltd., Tokyo (JP)

(72) Inventors: Toshiyasu Ito, Tokyo (JP); Yosuke Takai, Tokyo (JP); Taichi Enjoji, Tokyo (JP)

(73) Assignee: YAMAICHI ELECTRONICS CO., LTD., Tokyo (JP)

( * ) Notice: Subject to any disclaimer, the term of this patent is extended or adjusted under 35 U.S.C. 154(b) by 190 days.

(21) Appl. No.: 17/116,245

(22) Filed: Dec. 9, 2020

(65) Prior Publication Data

US 2021/0184383 A1 Jun. 17, 2021

(30) Foreign Application Priority Data

Dec. 11, 2019 (CN) ..... 201911264646.X
Dec. 11, 2019 (CN) ..... 201911264665.2
Dec. 11, 2019 (CN) ..... 201911264975.4

(51) Int. Cl.
*H01R 13/187* (2006.01)
*H01R 13/24* (2006.01)
(Continued)

(52) U.S. Cl.
CPC ..... *H01R 13/187* (2013.01); *H01R 12/716* (2013.01); *H01R 13/2492* (2013.01); *H01R 13/514* (2013.01); *H01R 13/6461* (2013.01)

(58) Field of Classification Search
CPC .. H01R 12/712; H01R 12/716; H01R 13/187; H01R 13/514; H01R 13/2492; H01R 13/6461
(Continued)

(56) References Cited

U.S. PATENT DOCUMENTS 6,093,035 A 7/2000 Lemke et al.
6,648,657 B1 11/2003 Korsunsky et al.
(Continued)

FOREIGN PATENT DOCUMENTS

CN 107611717 1/2018
CN 209329213 U 8/2019
(Continued)

OTHER PUBLICATIONS

European Search Report received in European Patent Application No. 20212682.7, Completed Apr. 26, 2021, dated May 6, 2021, 10 pages.
(Continued)

*Primary Examiner* — Khiem M Nguyen
(74) *Attorney, Agent, or Firm* — Hayes Soloway PC

(57) ABSTRACT

According to an embodiment of the present disclosure, a connector for high-speed transmission to be fitted with an external counterpart connector includes a housing and a plurality of terminals. The housing has at least one or more slots. The plurality of terminals includes ground terminals and signal terminals are arranged in the slot along a first direction orthogonal to a fitting direction of the connector. Partition walls are provided between adjacent terminals in the slot, and a height of the partition walls between the ground terminals and the signal terminals in the fitting direction is lower than a height of other partition walls in the fitting direction.

21 Claims, 24 Drawing Sheets

(51) Int. Cl.
*H01R 12/71* (2011.01)
*H01R 13/514* (2006.01)
*H01R 13/6461* (2011.01)

(58) Field of Classification Search
USPC ..... 439/843–847
See application file for complete search history.

(56) References Cited

U.S. PATENT DOCUMENTS

| | | | |
|---|---|---|---|
| 6,969,286 | B1 | 11/2005 | Mongold et al. |
| 8,052,436 | B1 | 11/2011 | Ju |
| 8,192,206 | B1 | 6/2012 | Ju |
| 9,166,343 | B1 | 10/2015 | Jeon et al. |
| 2004/0253852 | A1 | 12/2004 | Regnier et al. |
| 2010/0068942 | A1 | 3/2010 | Kodera et al. |
| 2010/0330844 | A1 | 12/2010 | Ito |
| 2012/0178298 | A1 | 7/2012 | Jin |
| 2015/0303598 | A1 | 10/2015 | Jeon et al. |
| 2019/0089097 | A1 | 3/2019 | Cho et al. |
| 2019/0207341 | A1 | 7/2019 | Huang |
| 2020/0136316 | A1 | 4/2020 | Cho et al. |

FOREIGN PATENT DOCUMENTS

| | | | |
|---|---|---|---|
| JP | 2018156936 | A | 10/2018 |
| WO | 03094304 | A1 | 11/2003 |

OTHER PUBLICATIONS

European Search Report received in European Patent Application No. 20213129.8. Completed Apr. 20, 2021, dated Apr. 30, 2021, 5 pages.

European Search Report received in European Patent Application No. 20213124.9, Completed Apr. 20, 2021, dated Apr. 29, 2021, 11 pages.

CONNECTOR FOR HIGH-SPEED TRANSMISSION AND METHOD FOR FIXING SOLDER TO FORK PORTION OF CONNECTOR FOR HIGH-SPEED TRANSMISSION

CROSS-REFERENCE TO RELATED APPLICATIONS

This application claims the benefit of Chinese Patent applications CN201911264975.4, CN201911264665.2, and CN201911264646.X, each filed on Dec. 11, 2019, the contents of which are each incorporated herein by reference.

FIELD

The present invention relates to a connector for high-speed transmission mounted on a circuit board.

BACKGROUND

Many of the connectors for high-speed transmission mounted on circuit boards are formed by arranging a plurality of sets of terminal arrays including signal terminals and ground terminals in the housing. As an example of documents disclosing a technique related to this type of connector, Japanese Patent Application Publication No. 2018-156936 (hereinafter referred to as "Patent Document 1") can be taken up. The connector described in Patent Document 1 has a signal terminal receiving groove which is an opening portion penetrating the bottom wall of the housing from the upper portion to the lower portions of the bottom wall. Ground terminals and signal terminals are alternately inserted in the signal terminal receiving groove. The tale portion of the lower end of the signal terminal is soldered to the mounting surface of the circuit board with a solder ball, and the terminal of a counterpart connector is held by the elastic contact portion thereof.

By the way, soldering of this type of connector to a substrate is performed by a so-called reflow method in which a solder paste is applied to the substrate, the connector is placed on the paste-applied portion, and then the substrate and the connector are heated and cooled.

However, there is still room for improvement on this conventional type of connector in terms of the efficiency of vibration transmission.

SUMMARY

The present disclosure has been made in view of such a problem, and one of objects thereof is to improve the efficiency of signal transmission of the connector for high-speed transmission.

In accordance with a first aspect of the present invention, there is provided a connector for high-speed transmission to be fitted with an external counterpart connector, which includes a housing, a plurality of terminals and partition walls. The housing has at least one slot. The plurality of terminals include ground terminals and signal terminals and are arranged in the slot along a first direction orthogonal to a fitting direction of the connector. The partition walls are provided between adjacent terminals in the slot. A height of the partition walls between the ground terminals and the signal terminals in the fitting direction is lower than a height of other partition walls in the fitting direction.

In accordance with a second aspect of the present invention, there is provided a connector for high-speed transmission including: a housing with a long hole extending in one direction; and a plurality of terminals arranged in the long hole. Each of the terminals includes a contact portion to contact an external counterpart connector and a soldering terminal portion to be soldered to an external mounting target substrate. The terminals are divided into a shield contact which is a component having the contact portion, and a shield plate which is a component having the soldering terminal portion. A first end portion of the shield contact on an opposite side of the contact portion and a second end portion of the shield plate on an opposite side of the soldering terminal portion are pressed into the long hole from directions opposite to each other, and the first and second end portions abut on each other in the long hole.

In accordance with a third aspect of the present invention, there is provided a contact for high speed transmission including a housing and a plurality of terminals. The plurality of terminals have contact portions in contact with a counterpart connector and soldering terminal portions soldered to a mounting target substrate in which the contact portions and the soldering terminal portions are arranged in the housing so as to face each other. The soldering terminal portion is a fork portion, and a cut piece of a wire solder is sandwiched and crimped in the fork portion.

In accordance with a fourth aspect of the present invention, there is provided a solder fixing method for fixing solder to a fork portion of a contact for high speed transmission. The method includes: a first step of pushing a cut piece into the fork portion; and a second step of sandwiching the cut piece of a wire solder with a tool and crimping it to the fork portion. The cut piece is obtained by cutting the wire solder into a piece longer than the width of the fork portion.

DETAILED DESCRIPTION

Hereinafter, a host connector CNH and a plug connector CNP, which are connectors for high-speed transmission according to an embodiment of the present invention, will be described with reference to the drawings. The host connector CNH and the plug connector CNP are used by soldering to the pads of an electronic substrate 90 and an extension substrate 91, respectively. The plug connector CNP is mounted on the extension substrate 91 while the host connector CNH is mounted on the electronic substrate 90. When the host connector CNH and the plug connector CNP are brought close to each other in the bold arrow direction shown in FIG. 1 and fitted, the terminal of the host connector CNH and the terminal of the plug connector CNP are electrically connected to each other, and high-speed transmission of up to 3.2 Tbps between the electronic substrate 90 and extension substrate 91 becomes possible.

In the following description, the fitting direction of the host connector CNH and the plug connector CNP is appropriately referred to as the Z direction, a direction orthogonal to the Z direction is appropriately referred to as the X direction and the direction orthogonal to the Z direction and the X direction is appropriately referred to as the Y direction. Further, the side where the host connector CNH is located as viewed from the plug connector CNP in the Z direction may be referred to as the upper side and the side where the plug connector CNP is located as viewed from the host connector CNH may be referred to as the lower side.

Figure 3:
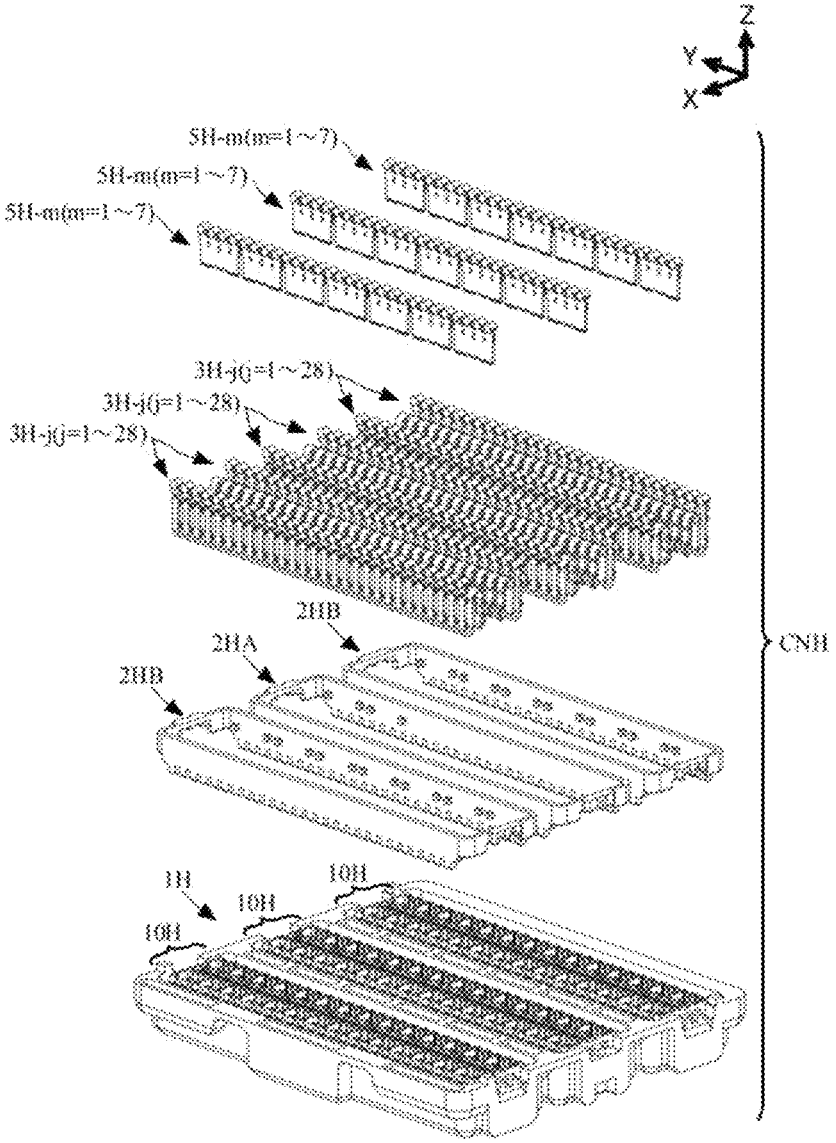
FIG. 3 is an exploded perspective view of the host connector CNH of FIG. 1B.

As shown in FIG. 3, the host connector CNH is provided with three slots 10H arranged in the X direction in the housing 1H. Conductive resins 2HA and 2HB, two rows of twenty-eight contacts 3H-j (j=1 to 28), and rows of four shield plates 5H-m (m=1 to 7) are mounted in each of the three slots 10H. All the contacts 3H-j (j=1 to 28) mounted in each slot 10H have the same shape. Further, the shapes of the shield plates 5H-m (m=1 to 7) mounted in each slot 10H are also all the same.

Figure 5:
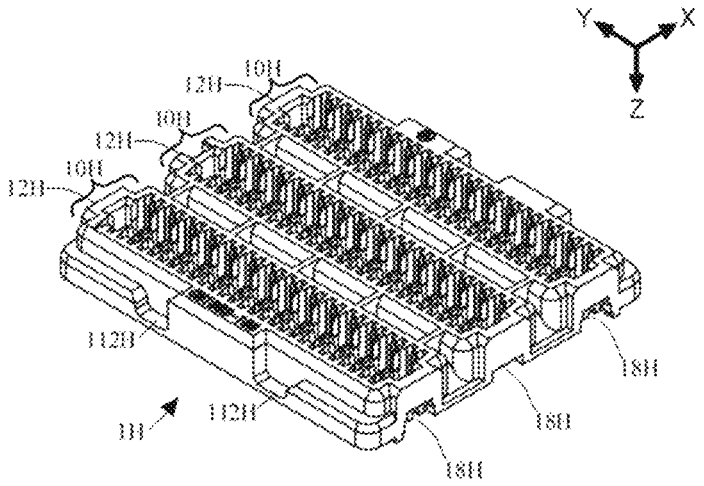
FIG. 5 is a perspective view of the housing 1H of FIG. 3.
Figure 6A:
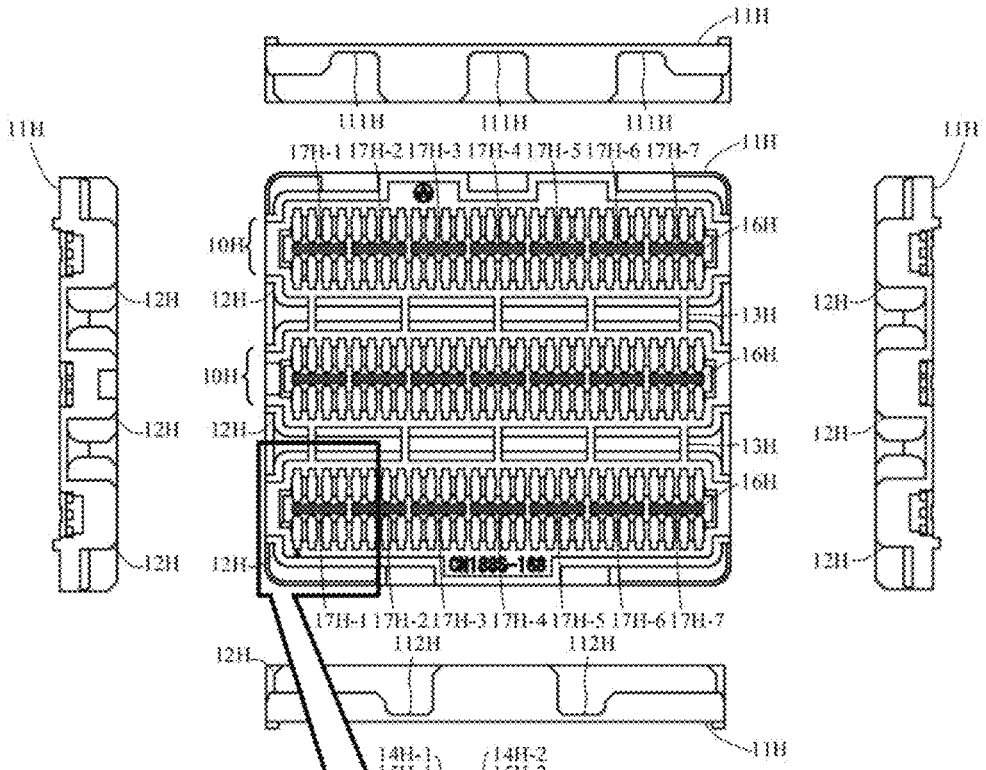
FIG. 6A shows a front view of the housing 1H of FIG. 3 and side views thereof as viewed from all sides.

As shown in FIG. 5 and FIG. 6, each of the three slots 10H of the housing 1H vertically penetrates three table portions 12H rising from the bottom portion 11H of the housing 1H. As shown in FIG. 6A, a plurality of reinforcing plates 13H are bridged between the adjacent table portions 12H. Three depressions 111H are formed on the outside of the table portion 12H on the +X side of the bottom portion 11H of the housing 1H. Two depressions 112H are formed on the outside of the table portion 12H on the −X side of the bottom portion 11H of the housing 1H.

Figure 7A:
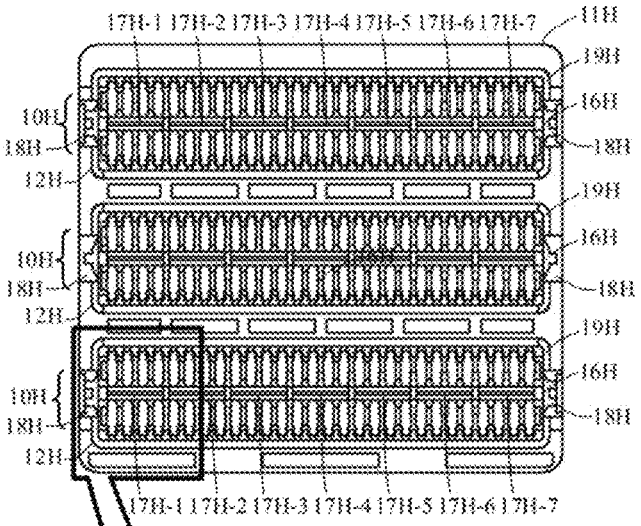
FIG. 7A is a rear view of the housing 1H of FIG. 3.
Figure 7B:
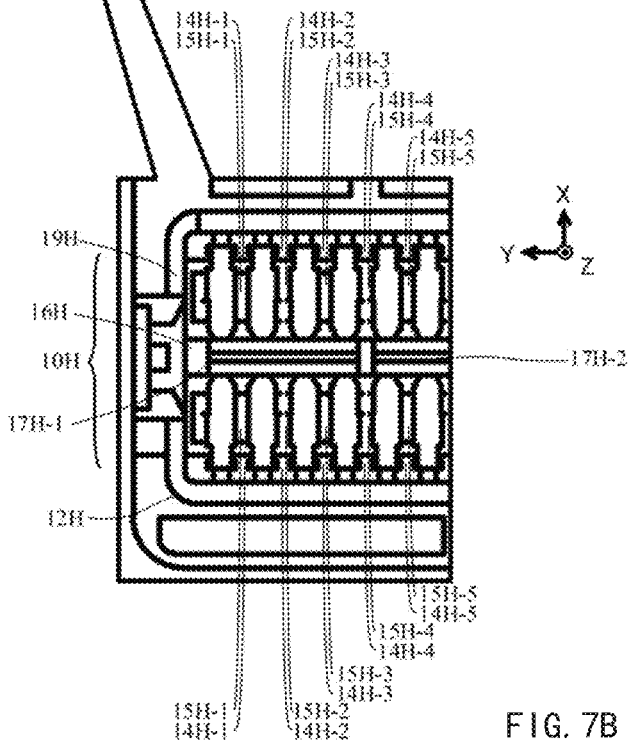
FIG. 7B is a partially enlarged view of the rear view of FIG. 7A.

As shown in FIG. 7A and FIG. 7B, a groove 19H is provided around each of the three slots 10H on the upper surface of the housing 1H. The groove 19H is formed in a rectangular frame shape that is horizontally long in the Y direction. Both sides of the groove 19H in the Y direction are open to the outside as open portions 18H.

Figure 8A:
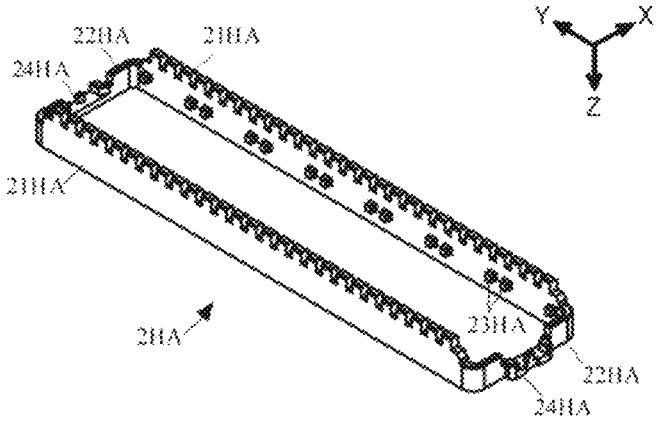
FIG. 8A is a perspective view of a conductive resin 2HA in the center of FIG. 3.

The conductive resin 2HA shown in FIG. 8A is embedded in the groove 19H around the central slot 10H. The conductive resin 2HA has a rectangular frame shape whose dimensions make it possible to be contained in the groove 19H. A plurality of projections 23HA are formed on the inner wall surface of the side wall 21HA facing the X direction in the conductive resin 2HA. An extension portion 24HA protruding outward in the Y direction is formed on the side wall 22HA facing the Y direction in the conductive resin 2HA. In a state where the conductive resin 2HA is contained in the groove 19H around the central slot 10H, the extension portion 24HA is fitted into the open portion 18H of the groove 19H. Further, the upper surface of the conductive resin 2HA is flush with the upper surface of the housing 1H.

Figure 8B:
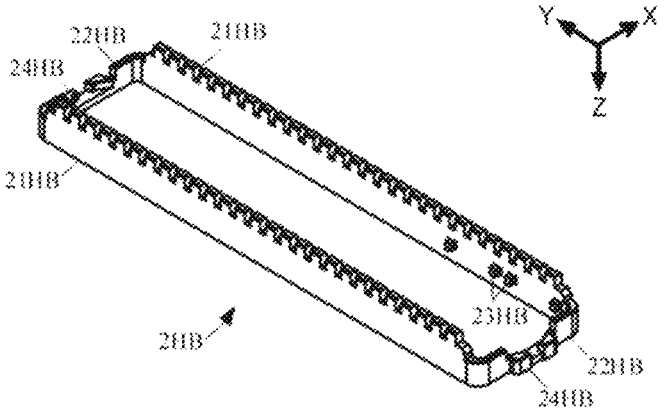
FIG. 8B is a perspective view of the conductive resin 2HB on both sides of the conductive resin 2HA.

The conductive resin 2HB shown in FIG. 8B is embedded in the groove 19H around the slot 10H on both sides in the X direction. The conductive resin 2HB has a rectangular frame shape whose dimensions make it possible to be contained in the groove 19H. A plurality of projections 23HB are formed on the inner wall surface of the side wall 21HB facing the X direction in the conductive resin 2HB. An extension portion 24HB protruding outward in the Y direction is formed on the side wall 22HB facing the Y direction in the conductive resin 2HB. In a state where the conductive resin 2HB is contained in the groove 19H around the central slot 10H on both sides in the X direction, the extension portion 24HB is fitted into the open portion 18H of the groove 19H. Further, the upper surface of the conductive resin 2HB is flush with the upper surface of the housing 1H.

Figure 4B:
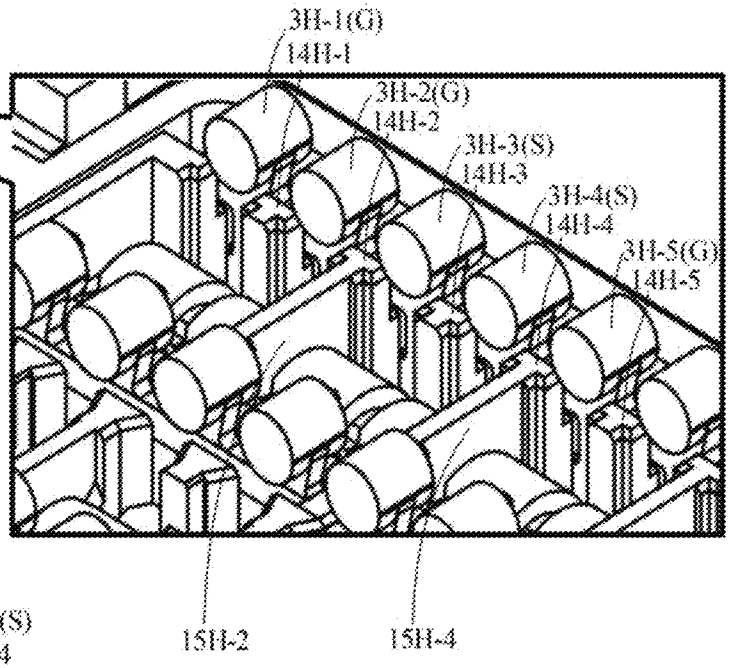
FIG. 4B is a partially enlarged view of FIG. 4A.
Figure 4A:
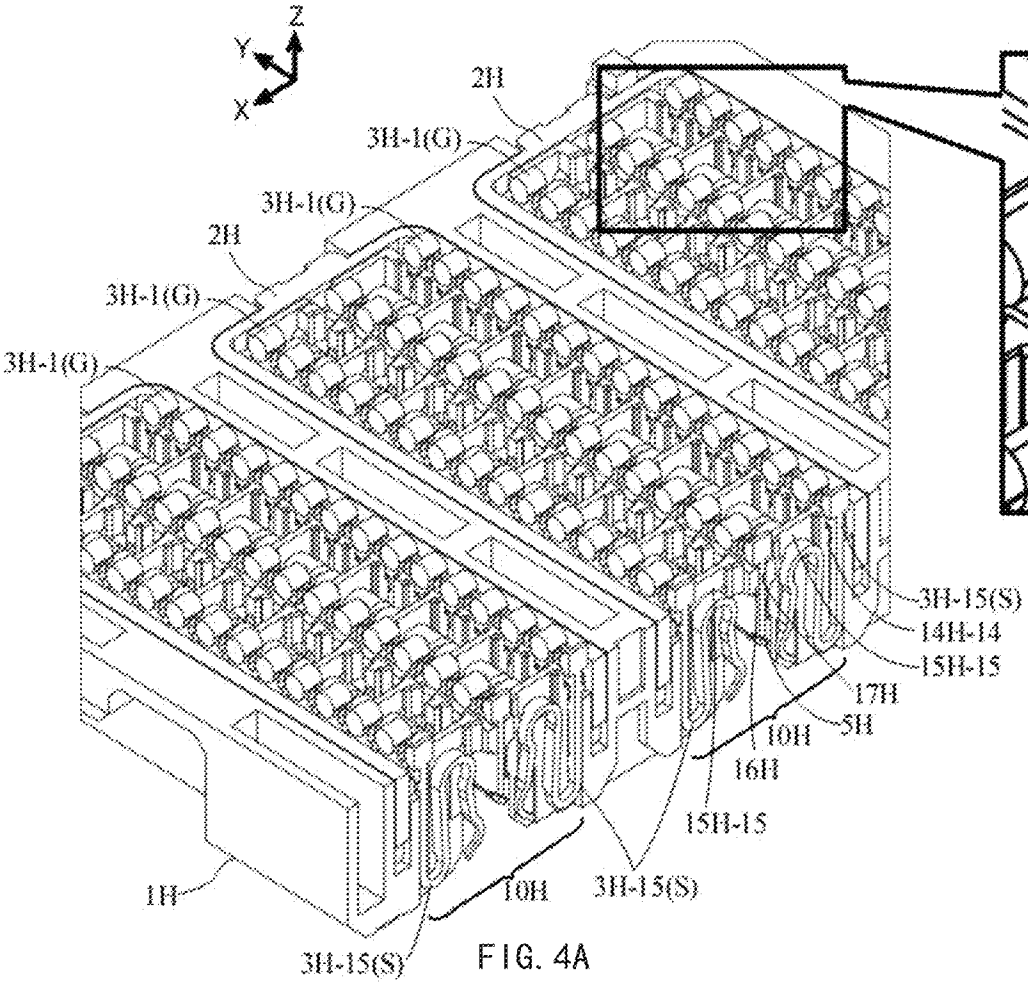
FIG. 4A is a perspective view including a cut surface of the host connector CNH of FIG. 1B, the cut surface passing through the center of the contact 3H-15(S) in the Y direction.
Figure 6B:
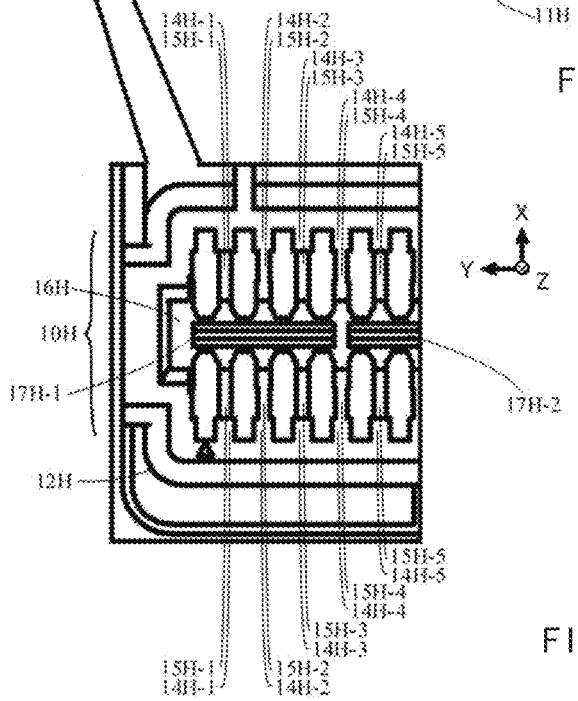
FIG. 6B is a partially enlarged view of the front view of FIG. 6A.

As shown in FIG. 4A, FIG. 6B, and FIG. 7B, twenty-seven ribs 14H-k (k=1 to 27) are provided on the inner wall surfaces of the housing 1H facing each other in the X direction and sandwiching the slot 10H in the table portion 12H. The ribs 14H-k protrude inwardly from the inner wall surface. The ribs 14H-k (k=1 to 27) are aligned in the Y direction at the same interval. The interval between the adjacent ribs 14H-k among the ribs 14H-k (k=1 to 27) is approximately the same as the width of the contact 3H-j in the Y direction.

On the upper side (+Z side) of the slot 10H in the table portion 12H of the housing 1H there is located a plate support 16H extending in the Y direction. A partition wall 15H-k (k=1 to 27) is provided between the plate support 16H and the rib 14H-k (k=1 to 27) of the slot 10H. As shown in FIG. 4A, FIG. 6B, and FIG. 7B, the partition wall 15H-k rises from the end surface on the inner side of the rib 14H-k toward the side of the plate support 16H. The plate support 16H is supported by the end portion of the partition wall 15H-k on the inner side opposite to the rib 14H-k. Seven long holes 17H-m (m=1 to 7) vertically penetrating the plate support 16H are bored in the plate support 16H.

Figure 9:
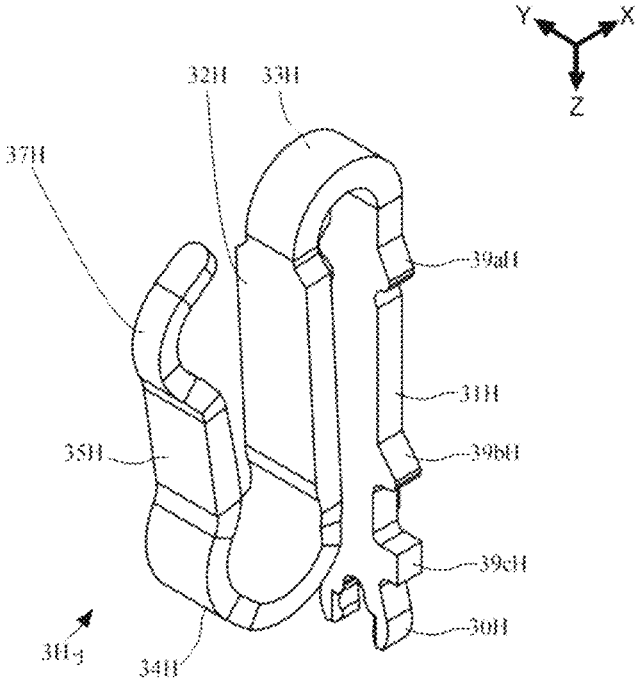
FIG. 9 is a perspective view of the contact 3H-j of FIG. 3.

As shown in FIG. 9, the contact 3H-j includes; a first linear portion 31H extending in the Z direction; a second linear portion 32H extending in parallel with the first linear portion 31H away from the first linear portion 31H on the −X side; a fork portion 30H bifurcated and extending from one end of the first linear portion 31H; a first curved portion 33H curved from an end portion opposite to the fork portion 30H side of the first linear portion 31H to the side of the second linear portion 32H in the X direction and connected to one end of the second linear portion 32H; a second curved portion 34H curved from the other end of the second linear portion 32H to the side opposite to the first linear portion 31H in the X direction; an inclined portion 35H extending slightly inclined from the end portion of the second curved portion 34H to a side away from the second linear portion 32H; and a contact portion 37H bending and extending in a hook-shape from the tip end of the inclined portion 35H.

Convex portions 39*a*H, 39*b*H, and 39*c*H protruding outward in the Y direction are formed on the side surface of the first linear portion 31H. The contact portion 37H is further inclined and extends from the base end connected to the inclined portion 35H toward the side opposite to the second linear portion 32H, and then bends and extends in a dogleg shape. The tip end of the contact portion 37H faces the first curved portion 33H. The width of the contact portion 37H in the Y direction is narrowed from the vicinity of the base end of the contact portion 37H. The width of tip end of the contact portion 37H in the Y direction is approximately half the width of the base end of the contact portion 37H in the Y direction.

Figure 10A:
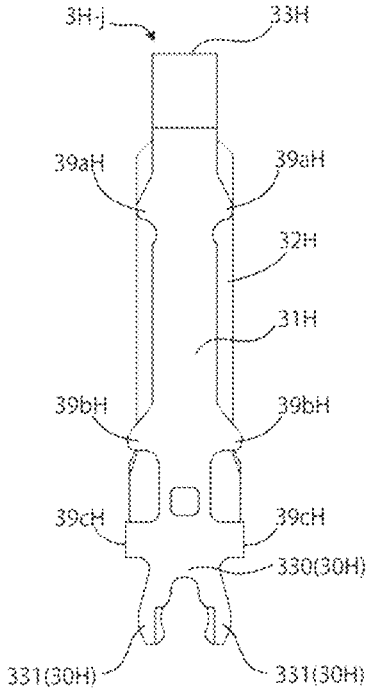
FIG. 10A is a view of the contact 3H-j of FIG. 9 as viewed from the +X side.
Figure 10B:
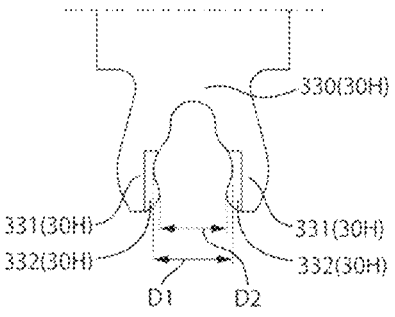
FIG. 10B is an enlarged view of the fork portion 30H of FIG. 10A.

The fork portion 30H of the contact 3H-j is a soldering terminal portion soldered to the pad of the electronic substrate 90 which is a mounting destination. As shown in FIG. 10A, the fork portion 30H has a base end portion 330, and two sandwiching portions 331 bifurcated and extending from the base end portion 330. The thickness of the inner edge portions 332 of the two sandwiching portions 331 facing inward is thinner than the thickness of the sandwiching portion 331 itself. As shown in FIG. 10B, the width D1 between portions on the tip end side of the inner edge portions 332 of the two sandwiching portions 331 is narrower than the width D2 between the portions of the base end portion locating nearer the base end portion 330 than the tip ends of the inner edge portions 332. The edge portion of the base end portion 330 facing the side of the two sandwiching portions 331 is curved in a semicircular shape.

Figure 11A:
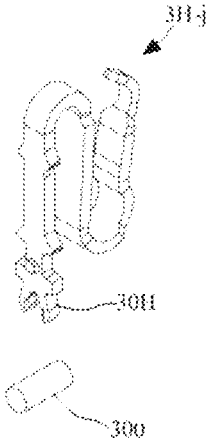
FIG. 11A to FIG. 11C are diagrams showing a working process of the contact 3H-j of FIG. 3.
Figure 11B:
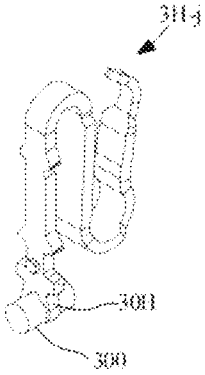
Figure 12A:
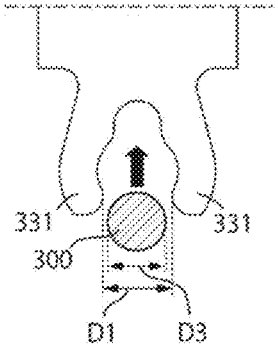
FIG. 12A to FIG. 12C are diagrams showing the relationship between the fork portion 30H shown in FIG. 11 and the wire solder fixed to the fork portion 30H.
Figure 12B:
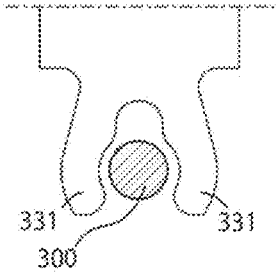

Solder is sandwiched and crimped in the fork portion 30H of the contact 3H-j. The solder is fixed to the fork portion 30H by the following procedure. First, as shown in FIG. 11A, a cut piece 300 of a wire solder is prepared by cutting the wire solder into a piece longer than the width of the fork portion 30H in the X direction. Next, as shown in FIG. 11B, the cut piece 300 of the wire solder is pushed in between the two sandwiching portions 331 of the fork portion 30H. As shown in FIG. 12A, the diameter D3 of the cut piece 300 of the wire solder is smaller than the width D1 between the inner edges of the two sandwiching portions 331 on the tip end side. When the cut piece 300 of the wire solder is pressed in, the cut piece 300 pushes the two sandwiching portions 331 outward to be contained between them, and is sandwiched between the two sandwiching portions 331. After the cut piece 300 of the wire solder is pressed in between the sandwiching portions 331 of the fork portion 30H, both ends of the cut piece 300 of the wire solder are sandwiched by a tool and crimped to the fork portion 30H. The cutting of the solder and the pushing of the solder in between the sandwiching portions 331 of the fork portion 30H may be performed collectively for a plurality of contacts 3H-j. In that case, it is advisable to pass a long wire solder through the fork portion 30H of a plurality of contacts 3H-j obtained in a state of being continuously connected by press molding, and then cut the wire solder into an appropriate length.

Figure 11C:
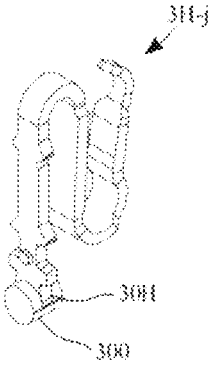
Figure 12C:
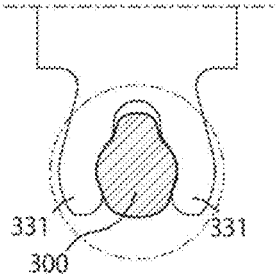

As shown in FIG. 11C and FIG. 12C, the solder fixed by the above procedure spreads up to the surface on the outer side of the fork portion 30H, a part of the outer surface on the outer side of the sandwiching surface of the fork portion 30H is then covered by the solder, thus the solder is integrated with the fork portion 30H.

Here, the contacts 3H-j (j=1 to 28) of each slot 10H include contacts 3H-j serving as ground terminals and contacts 3H-j serving as signal terminals. Hereinafter, as appropriate, a letter (G) is attached to the ground contact 3H-j and a letter (S) is attached to the signal contact 3H-j to distinguish between the two.

As shown in FIG. 4B, two rows of contacts 3H-j (j=1 to 28) on the +X side and the −X side in the long holes 17H-m (m=1 to 7) in each slot 10H are contained one by one in the gap between the adjacent partition walls 15H-k in the slot 10H in such a manner that two ground contacts and two signal contacts are aligned alternately. For example, on the +X side of the long hole 17H-1 shown in FIG. 6B and FIG. 7B, the ground contact 3H-1(G) is contained in the gap between the inner wall of the table portion 12H on the +Y side and the partition wall 15H-1, and the ground contact 3H-2(G) is contained in the gap between the partition wall 15H-1 and the partition wall 15H-2. The signal contact 3H-3(S) is contained in the gap between the partition wall 15H-2 and the partition wall 15H-3, and the signal contact 3H-4(S) is contained in the gap between the partition wall 15H-3 and the partition wall 15H-4. The same applies to the −X side of the long hole 17H-1.

The solder fixed to the fork portion 30H of the contact 3H-j faces upward, and the contact portion 37H of the contact 3H-j faces downward. The solder of the contact 3H-j is supported by the upper end of the rib 14H-k and the solder is exposed above the upper surface of the housing 1H.

Of the partition walls 15H-k (k=1 to 28) in the slot 10H, a first height of the partition walls 15H-k between the ground contacts 3H-j(G) and the signal contacts 3H-j(S) in the Z direction is lower than a second height of the partition walls 15H-k between the ground contacts 3H-j(G) in the Z direction and is lower than a third height of the partition walls 15H-k between the signal contacts 3H-j(S), in the Z direction, in which the partition walls 15H-k of the second and third heights are the other partition walls 15H-k.

Figure 1A:
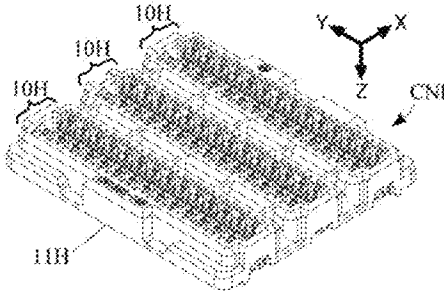
FIGS. 1A and 1B are perspective views of a host connector CNH according to an embodiment of the present invention as viewed from two directions.
Figure 1B:
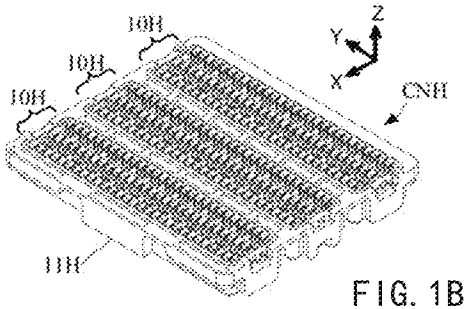
Figure 1C:
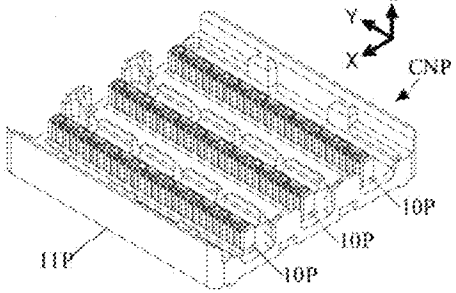
FIGS. 1C and 1D are perspective views of a plug connector CNP according to an embodiment of the present invention as viewed from two directions.
Figure 1D:
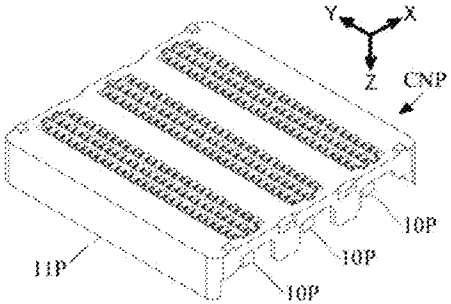
Figure 2:
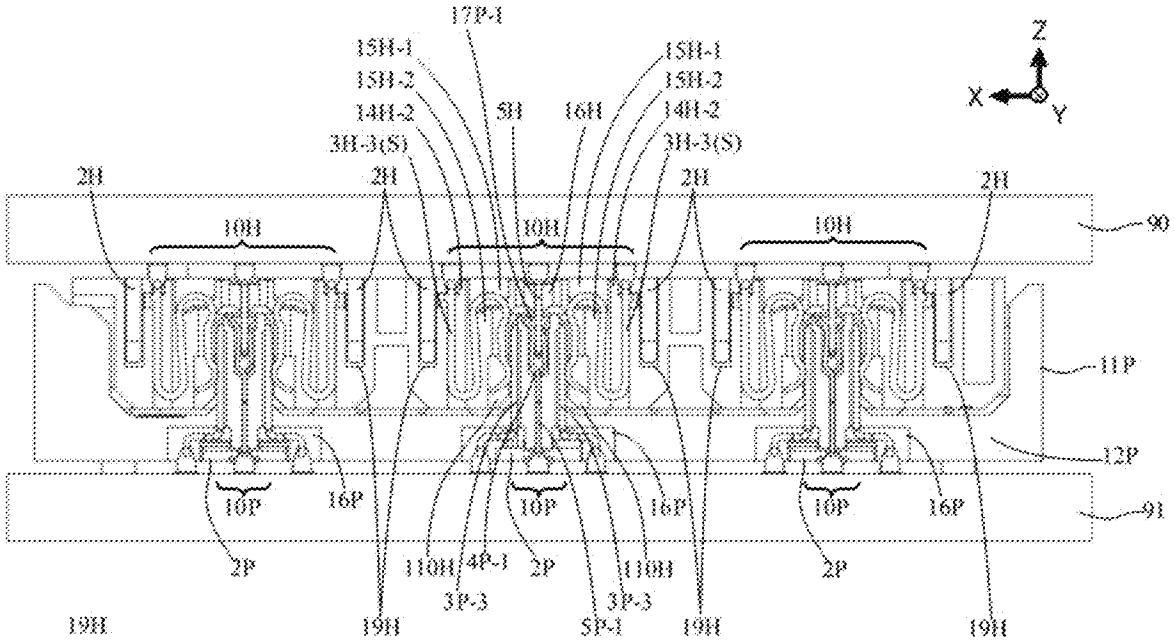
FIG. 2 is a diagram showing a cut surface parallel to the XZ plane between the contact 3H-3(S) and the contact 3H-4(S) of an assembly constituted by fitting the host connector CNH into the plug connector CNP shown in FIGS. 1A-1D.

More specifically, as shown in FIG. 2, the partition wall 15H-k between the ground contacts 3H-j (G) (in the cross section of FIG. 2, the partition wall 15H-1 at the back in the Y direction) has a lower end at substantially the same position as the lower surface of the housing 1H, and an upper end at substantially the same position as the upper surface of the housing 1H. The same applies to the partition wall 15H-k between the signal contacts 3H-j(S).

In contrast, regarding the partition wall 15H-k between the ground contact 3H-j(G) and the signal contact 3H-j(S) (in the cross section of FIG. 2, the partition wall 15H-2 in front of the Y direction), a lower end thereof locates at substantially the same position as the lower surface of the housing 1H, and an upper end thereof locates below the upper surface of the housing 1H and around the boundary between the first linear portion 31H and the second curved portion 34H of the contact 3H-j. Further, the upper end of the partition wall 15H-k between the ground contact 3H-j (G) and the signal contact 3H-j(S) is formed in a slope shape that becomes lower as the distance from the central plate support 16H increases.

Further, the substantially rectangular portion of the partition wall 15H-k between the ground contact 3H-j(G) and the signal contact 3H-j(S) immediately beside the contact portion 37H of the contact 3H-j is cut out so as to form a notch portion 110H.

Therefore, although the first linear portion 31H and the second linear portion 32H of the ground contact 3H-j(G) are separated from the first linear portion 31H and the second linear portion 32H of the signal contact 3H-j(S) by the partition wall 15H-k, the first curved portion 33H, the second curved portion 34H, and the contact portion 37H of the ground contact 3H-j are not separated from the first curved portion 33H, the second curved portion 34H, and the contact portion 37H of the signal contact 3H-j(G) by the partition wall 15H-k. An air layer are formed between the first curved portion 33H, the second curved portion 34H, the contact portion 37H of the ground contact 3H-j(G) and the first curved portion 33H, the second curved portion 34H, the contact portion 37H of the signal contact 3H-j(S).

Figure 13:
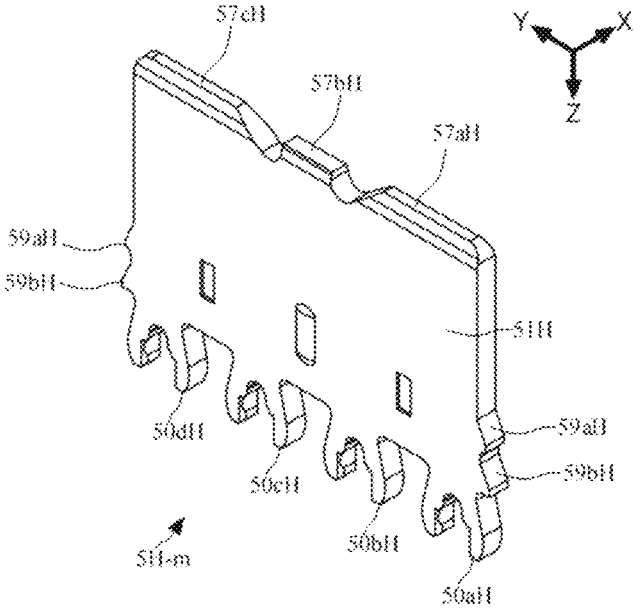
FIG. 13 is a perspective view of the shield plate 5H-m of FIG. 3.

As shown in FIG. 13, the shield plate 5H-m includes: a main body portion 51H; four fork portions 50*a*H, 50*b*H, 50*c*H, 50*d*H bifurcated and extending from four locations, separated in the Y direction, at the upper end of the main body portion 51H; contact portions 57*a*H, 57*b*H, 57*c*H protruding from locations sandwiching two grooves at the lower end of the main body portion 51H. Convex portions 59*a*H, 59*b*H protruding outward in the Y direction are formed on the side surface of the main body portion 51H.

The fork portions 50*a*H, 50*b*H, 50*c*H, 50*d*H of the contact 3H-j are a soldering terminal portions soldered to the pads of the electronic substrate 90 which is a mounting destination. Solders are sandwiched and crimped in the fork portions 50*a*H, 50*b*H, 50*c*H, 50*d*H of the shield plate 5H-m. The procedure for fixing the solders to the fork portions 50*a*H, 50*b*H, 50*c*H, 50*d*H is the same with the procedure for fixing the solder to the fork portion 30H of the contact 3H-j.

The shield plate 5H-m is pressed into the long hole 17H-m of the plate support 16H in the slot 10H from the upper side. The solders fixed to the fork portions 50*a*H, 50*b*H, 50*c*H, 50*d*H of the shield plate 5H-m are exposed on the upper side of the upper surface of the housing 1H.

Figure 14:
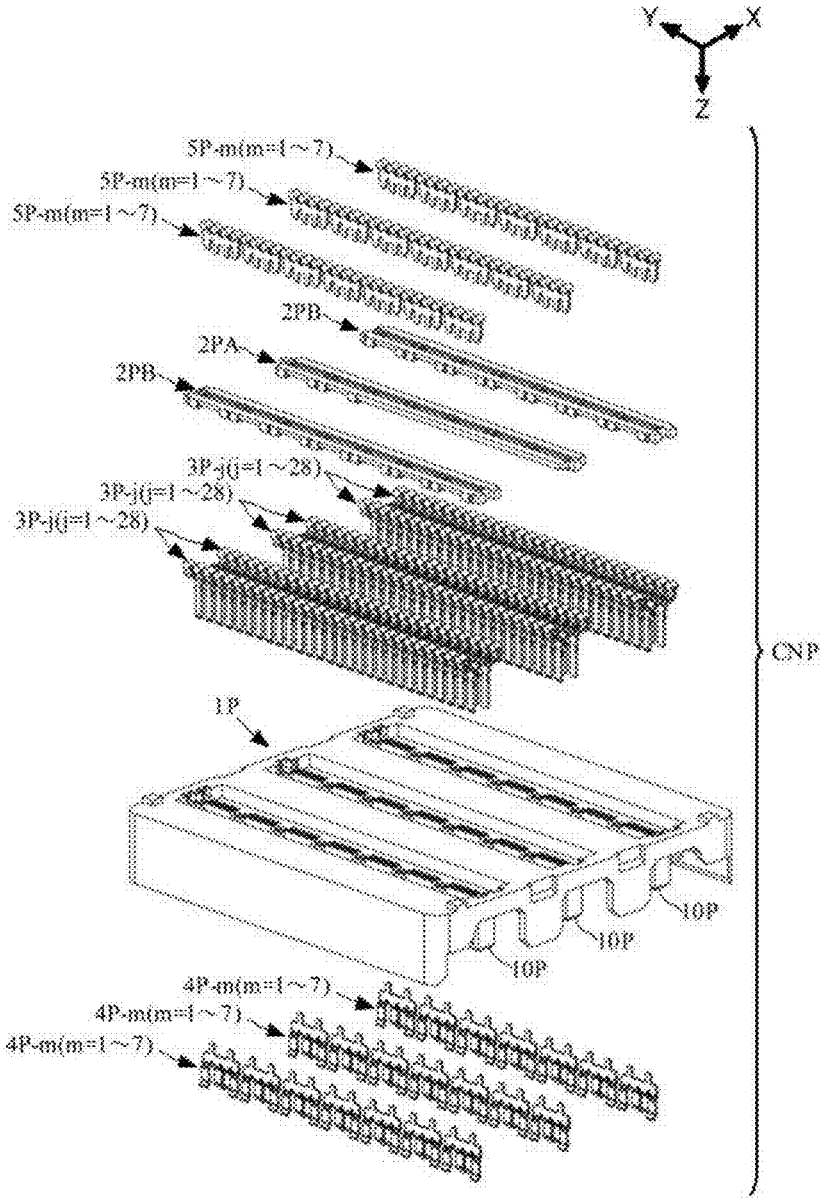
FIG. 14 is an exploded perspective view of the plug connector CNP of FIG. 1D.
Figure 15:
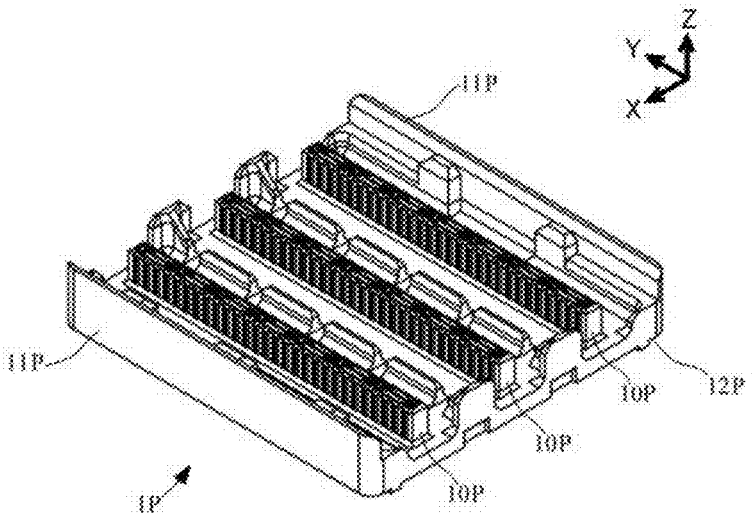
FIG. 15 is a perspective view of the housing 1P of FIG. 14.

As shown in FIG. 14, the plug connector CNP is provided with three headers 10P corresponding to the slots 10H of the host connector CNH in the housing 1P, and conductive resin 2PA and 2PB, two rows of twenty-eight contacts 3P-j (j=1 to 28), rows of seven shield contacts 4P-m (m=1 to 7), and rows of seven shield plates 5P-m (m=1 to 7) are mounted to each of the three headers 10P. All the contacts 3P-j (j=1 to 28) mounted to each header 10P have the same shape. Further, all the shield contacts 4P-m (m=1 to 7) mounted to each header 10P have the same shape, and all the shield plates 5P-m (m=1 to 7) also have the same shape.

Figure 22:
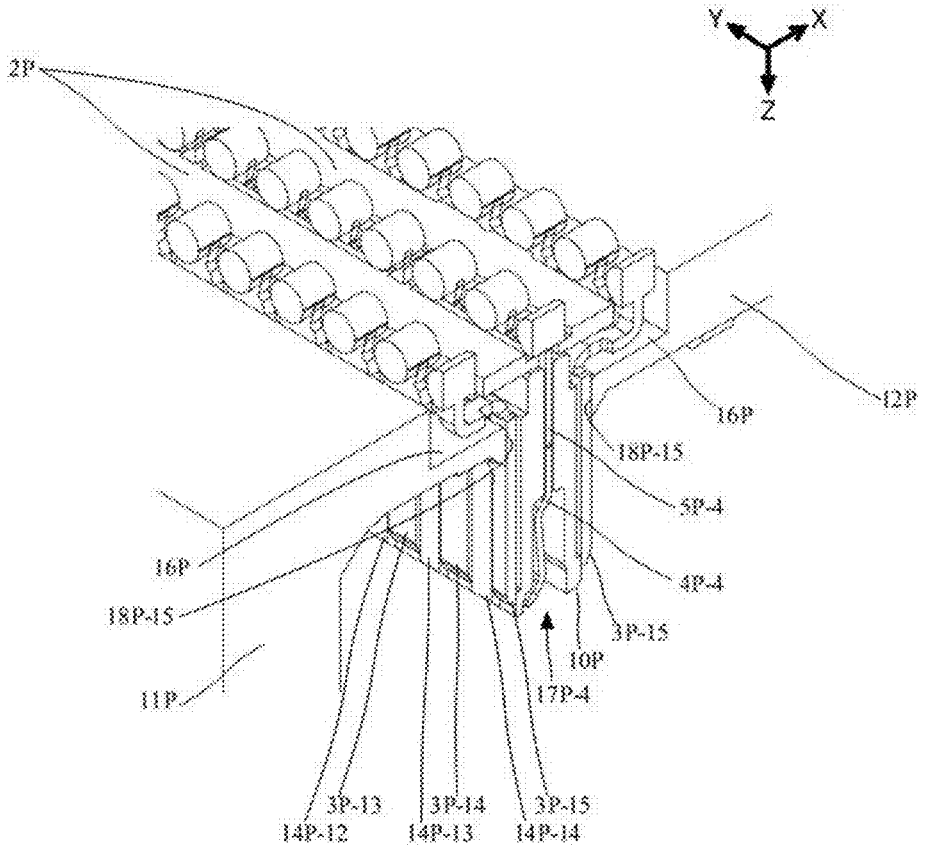
FIG. 22 is a perspective view including a cut surface passing through the center of the contact 3P-15 in the Y direction in FIG. 1D.

As shown in FIG. 22, the outer wall surfaces on both sides of the header 10P in the X direction are provided with twenty-seven ribs 14P-k (k=1 to 27). The ribs 14P-k are formed in a thin rectangular shape. The ribs 14P-k are aligned in the Y direction at the same interval. The interval between the adjacent ribs 14P-k among the ribs 14P-k (k=1 to 27) is approximately the same as the width of the contact 3P-j in the Y direction.

A groove 16P is provided at a position on the bottom wall 12P of the housing 1P on the side opposite to the header 10P. The upper end of the header 10P is located slightly lower than the upper edges of the side walls 11P on both sides of the housing 1P in the X direction. The lower end of the header 10P protrudes below the lower surface of the groove 16P.

Figure 16A:
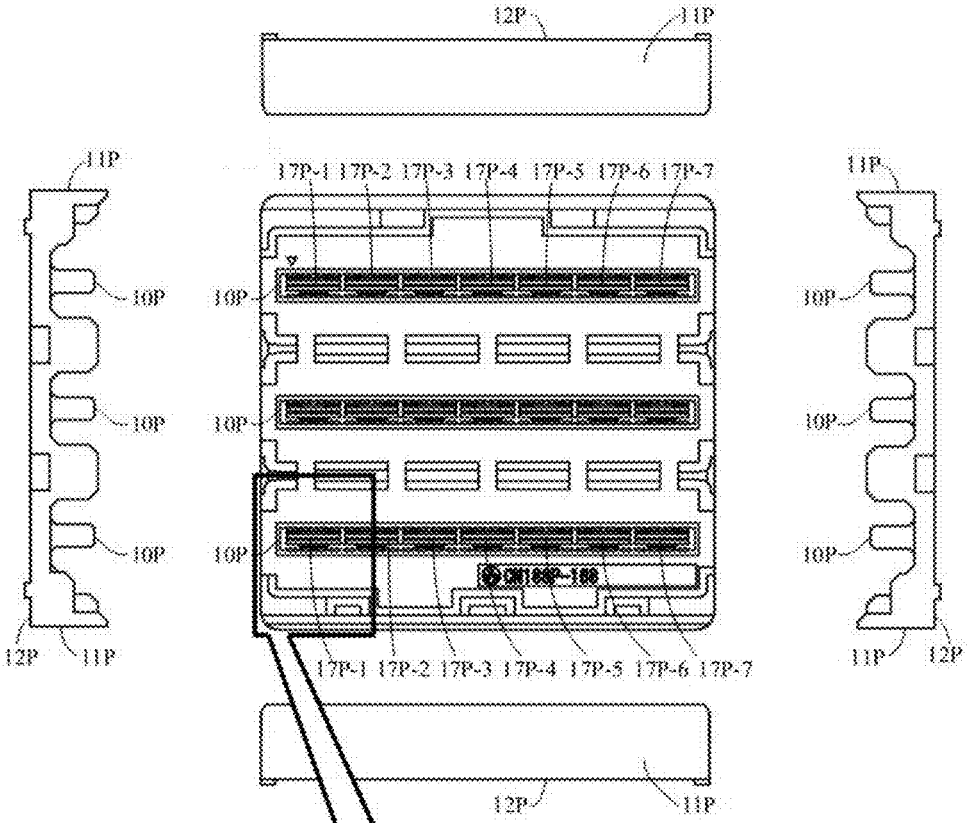
FIG. 16A shows a front view of the housing 1P of FIG. 15 and side views thereof as viewed from all sides.
Figure 16B:
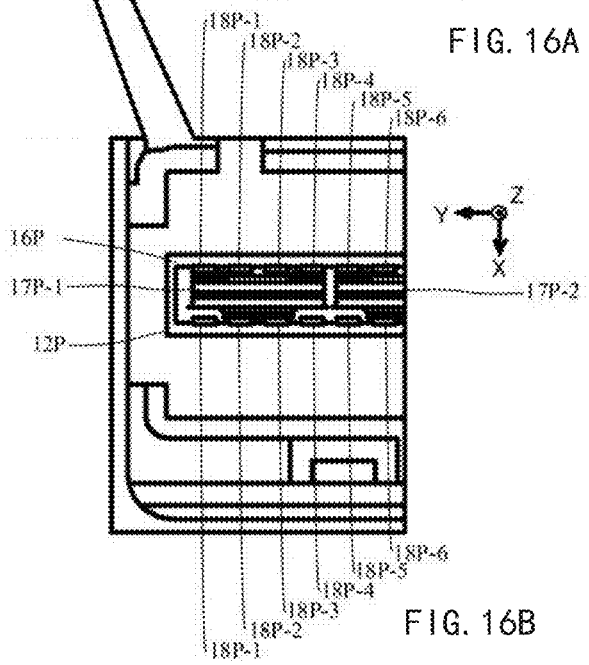
FIG. 16B is a partially enlarged view of the front view of FIG. 16A.
Figure 17A:
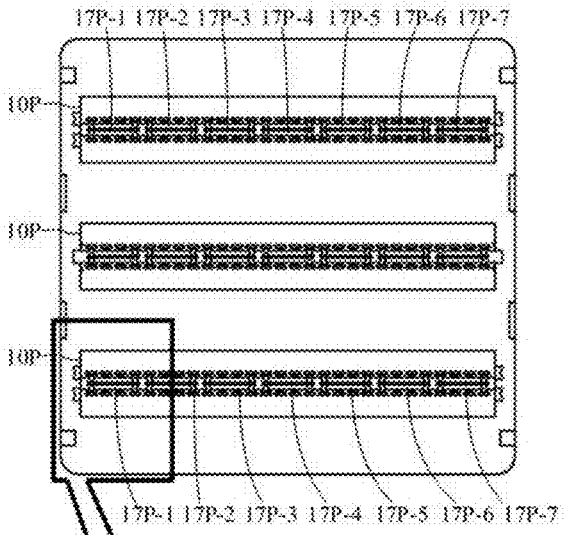
FIG. 17A is a rear view of the housing 1P of FIG. 15.
Figure 17B:
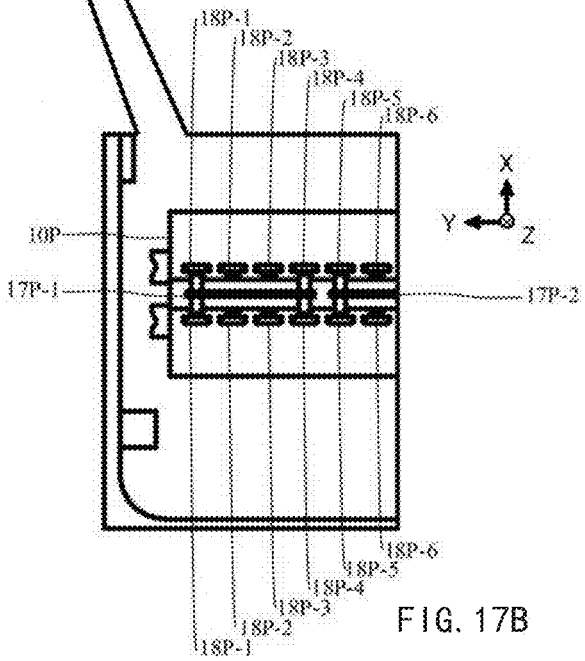
FIG. 17B is a partially enlarged view of the rear view of FIG. 17A.

As shown in FIG. 16A and FIG. 16B, seven long holes 17P-m (m=1 to 7) vertically penetrating the header 10P are bored in the header 10P. The width of the lower portion of the long hole 17P-m in the X direction is narrower than the width of the upper portion in the X direction. Further, as shown in FIG. 16A, FIG. 16B, and FIG. 22, twenty-eight long holes 18P-j (j=1 to 28) are bored in the bottom wall 12P at positions directly below between the adjacent ribs 14P-k on both sides of the base end of the header 10P in the X direction. The long holes 18P-j (j=1 to 28) penetrate between the upper surface of the bottom wall 12P and the bottom surface of the groove 16P on the back side thereof.

Figure 18A:
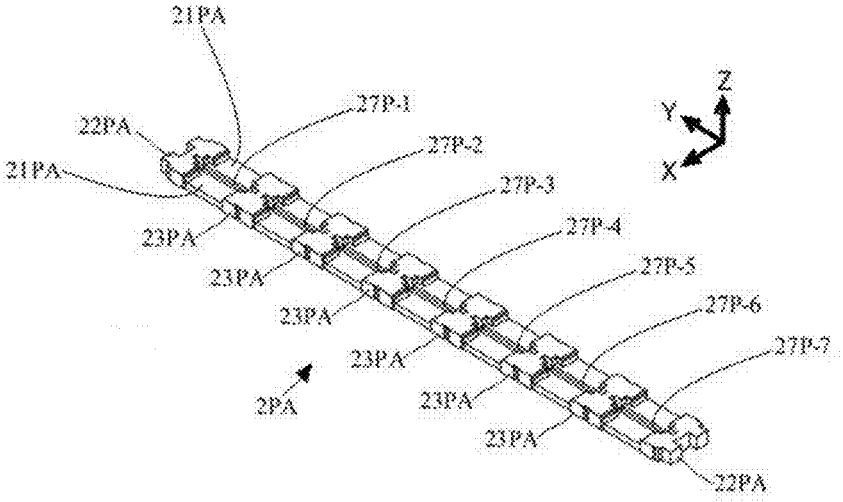
FIG. 18A is a perspective view of the conductive resin 2PA of FIG. 1C.

The conductive resin 2PA shown in FIG. 18A is fitted into the lower end of the central header 10P in the groove 16P. The conductive resin 2PA has two long plates 21PA facing each other with a slight gap therebetween and both ends of the two long plates 21PA in the Y direction are connected to each other via the connection pieces 22PA. Seven long holes 27P-m (m=1 to 7) divided by the division pieces 23PA are formed in the gap between the two long plates 21PA. In a state where the conductive resin 2PA is fitted in the lower end of the central header 10P, the lower surface of the conductive resin 2PA is flush with the lower surface of the 1P.

Figure 18B:
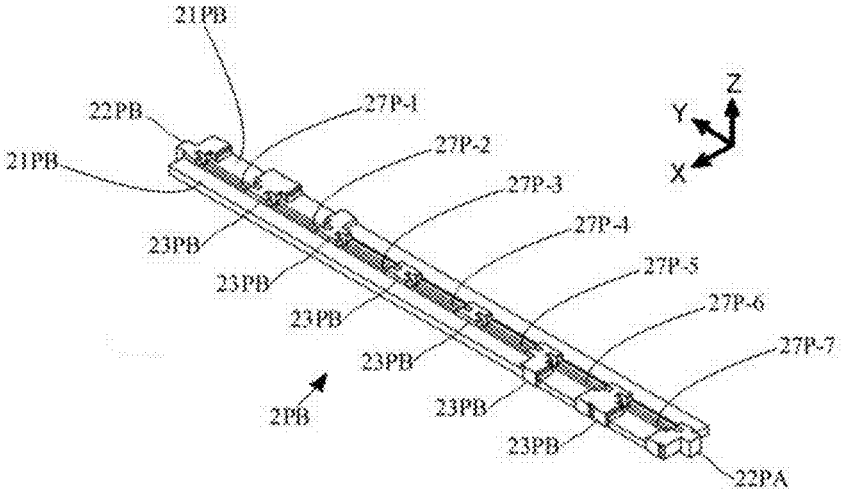
FIG. 18B is a perspective view of the conductive resin 2PB on both sides of the conductive resin 2PA of FIG. 18A.

The conductive resin 2PB shown in FIG. 18B is fitted into the lower ends of the headers 10P on both sides of the groove 16P in the X direction. The conductive resin 2PB has two long plates 21PB facing each other with a slight gap therebetween and both ends of the two long plates 21PB in the Y direction are connected via the connection pieces 22PB. Seven long holes 27P-m (m=1 to 7) divided by the division pieces 23PB are formed in the gap between the two long plates 21PB. In a state where the conductive resin 2PB is fitted in the lower end of the central header 10P, the lower surface of the conductive resin 2PB is flush with the lower surface of the 1P.

Figure 19:
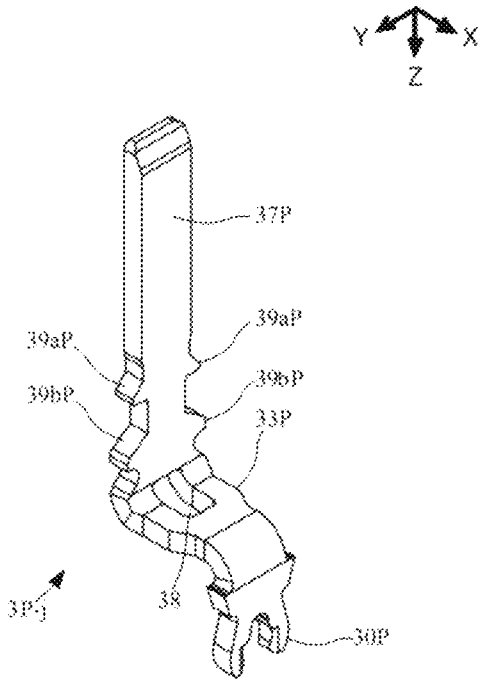
FIG. 19 is a perspective view of the contact 3P-j of FIG. 14.

As shown in FIG. 19, the contact 3P-j includes: a contact portion 37P extending linearly in the Z direction; a bent portion 33P bending and extending from the base end of the contact portion 37P to one side of the X direction; and a fork portion 30P bifurcated and extending from the end portion opposite to the contact portion 37P at the bent portion 33P. Convex portions 39*a*P, 39*b*P protruding outward in the Y direction are formed on the side surface of the contact portion 37P. A hole 38 is bored in the center of the bent portion 33P in the Y direction.

The fork portion 30P of the contact 3P-j is a soldering terminal portion soldered to the pad of the extension substrate 91 which is a mounting destination. Solder is sandwiched and crimped in the fork portion 30P of the contact 3P-j. The procedure for fixing the solder to the fork portion 30P is the same as the procedure for fixing the solder to the fork portion 30H of the contact 3H-j shown in FIGS. 11A-11C.

As shown in FIG. 2 and FIG. 22, the contacts 3P-j fixed with solders pass through the long hole 18P-j of the header 10P from the lower side and are contained one by one in the gaps between the adjacent ribs 14P-k in the header 10P. The bent portion 33P of the contact 3P-j is supported by the edge portion of the long hole 18P-j in the bottom wall 12P of the housing 1P, and the solder of the contact 3P-j is exposed on the lower side of the lower surface of the housing 1P.

Figure 20:
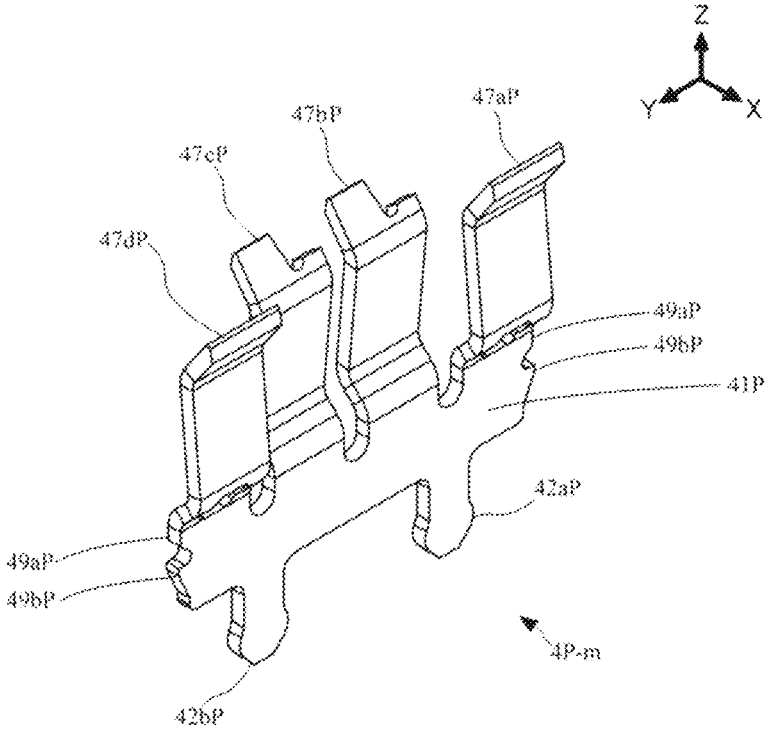
FIG. 20 is a perspective view of the shield contact 4P-m of FIG. 14.

As shown in FIG. 20, the shield contact 4P-m includes: a main body portion 41P; contact portions 47*a*P, 47*b*P, 47*c*P, 47*d*P bending and extending in a dogleg shape from four locations separated in the Y direction at the lower end of the main body portion 41P; and convex portions 42*a*P, 42*b*P protruding from two locations at the upper end of the main body portion 41P on the opposite side of, and between the contact portion 47*a*P and the contact portion 47*b*P, and the opposite side of, and between the contact portion 47*c*P and the contact portion 47*d*P. Convex portions 49*a*P, 49*b*P protruding outward in the Y direction are formed on the side surface of the main body portion 41P.

Of the contact portions 47*a*P, 47*b*P, 47*c*P, 47*d*P, the bending orientation of two contact portions 47*a*P and 47*d*P on the outer side and the bending orientation of two contact portions 47*b*P and 47*c*P on the inner side in the Y direction, which is the arrangement direction of the contact portions, are reversed. The upper ends of the two contact portions 47*a*P and 47*d*P on the outer side and the upper ends of the two contact portions 47*b*P and 47*c*P on the inner side are inclined in directions away from each other and open in a Y shape when viewed from the Y direction. The lower ends of the convex portions 42*a*P, 42*b*P are rounded.

Figure 21:
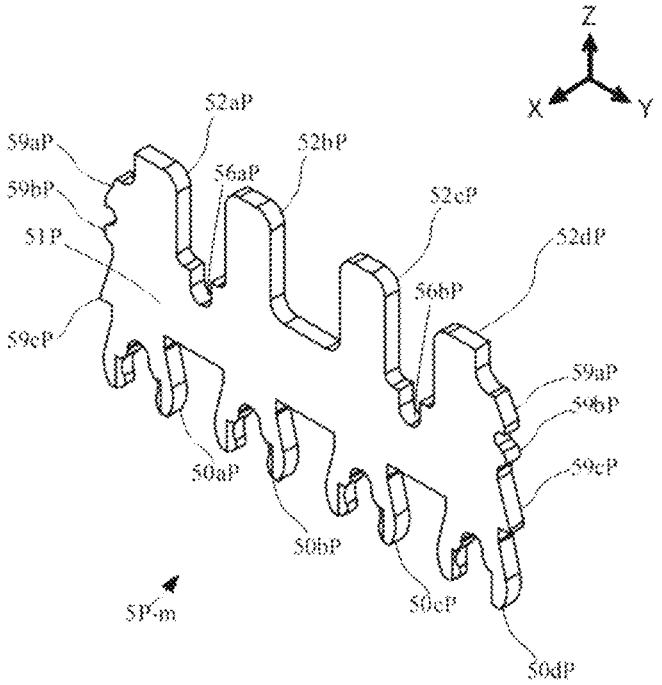
FIG. 21 is a perspective view of the shield plate 5P-m of FIG. 14.

As shown in FIG. 21, the shield plate 5P-m includes: a main body portion 51P; convex portions 52*a*P, 52*b*P, 25*c*P, 52*d*P protruding from four locations separated in the Y direction at the lower end of the main body portion 51P; and fork portions 50*a*P, 50*b*P, 50*c*P, 50*d*P bifurcated and extending four locations separated in the Y direction at the lower end of the main body portion 51P. Convex portions 59*a*P, 59*b*P, 59*c*P protruding outward in the Y direction are formed on the side surfaces of the main body portion 51P and the convex portions 52*a*P and 52*d*P. At the upper end of the main body portion 51P recess portions 56*a*P and 56*b*P are formed. The recess portions 56*a*P are gouged downward between the convex portion 52*a*P and the convex portion 52*b*P, and The recess portions 56*b*P are gouged downward between the convex portion 52*c*P and the convex portion 52*d*P.

The fork portions 50*a*P, 50*b*P, 50*c*P, 50*d*P of the shield plate 5P-m are soldering terminal portions soldered to the pads of the extension substrate 91 which is a mounting destination. Solders are sandwiched and crimped in the fork portions 50*a*P, 50*b*P, 50*c*P, 50*d*P of the shield plate 5P-m. The procedure for fixing the solders to the fork portions 50*a*P, 50*b*P, 50*c*P, 50*d*P is the same as the procedure for fixing the solder to the fork portion 30P of the contact 3P-j.

Figure 23:
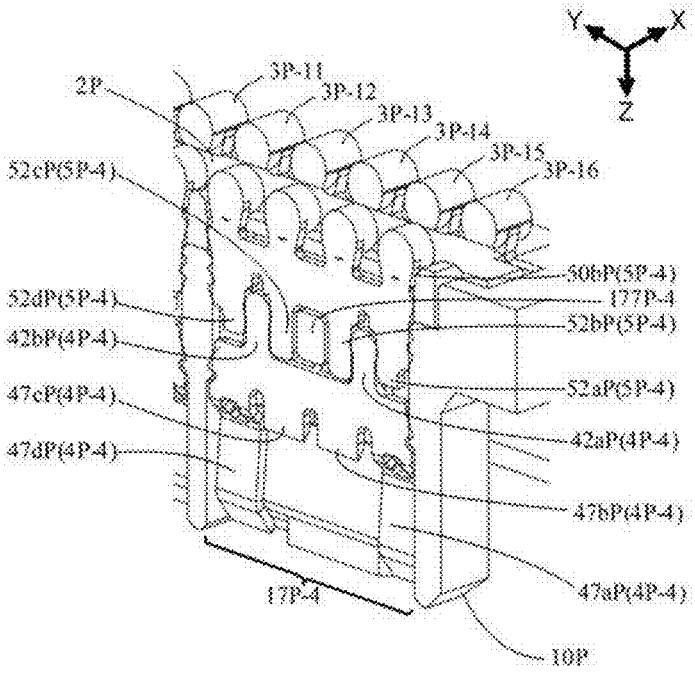
FIG. 23 is a cross-section view of the fitting portion of the shield plate 5P-4 and the shield contact 4P-4 in FIG. 1D.

As shown in FIG. 2 and FIG. 22, the shield contact 4P-m is pressed into the long hole 17P-m of the header 10P from the upper side, and the shield plate 5P-m fixed with solders is pressed into the long hole 17P-m of the header 10P from the lower side through the long hole 27P-m of the conductive resin 2PA (or 2PB). The end portion of the shield contact 4P-m and the end portion of the shield plate 5P-m abut on each other in the long hole 17P-m. More specifically, as shown in FIG. 23, a rectangular locking piece 177P-m is bridged between the inner wall surfaces of the long hole 17P-m of the header 10P facing each other in the X direction, and the shield contact 4P-m and the shield plate 5P-m are positioned by this locking piece 177P-m. In this disclosure, the end portion of the shield contact 4P-m and the end portion of the shield plate 5P-m are appropriately referred to as "the first end portion" and "the second end portion", respectively.

The locking piece 177P-m is fitted in a depression between the convex portion 52*b*P and the convex portion 52*c*P of the shield plate 5P-m. Further, the convex portion 42*a*P of the shield contact 4P-m is fitted in a depression between the convex portion 52*a*P and the convex portion 52*b*P of the shield plate 5P-m, and the convex portion 42*b*P of the shield contact 4P-m is fitted in a depression between the convex portion 52*c*P and the convex portion 52*d*P of the shield plate 5P-m. Further, notches are provided in the inner wall surfaces of the long hole 17P-m of the header 10P facing each other in the Y direction. The convex portions 49*a*P and 49*b*P of the shield contact 4P-m and the convex portions 59*a*P, 59*b*P, 59*c*P of the shield plate 5P-m are engaged with the notches to prevent the shield contact 4P-m and shield plate 5P-m from coming off. The long hole 17H-m of the slot 10H of the host connector CNH also has notches which play a similar role.

In a case where the plug connector CNP is fitted with the host connector CNH which is a mating connector, the contact portions 47*a*P, 47*b*P, 47*c*P, 47*d*P of the shield contact 4P-m of the plug connector CNP are in contact with the contact portions 57*a*H, 57*b*H, 57*c*H of the shield plate 5H-m of the host connector CNH, and the contact portion 37P of the contact 3P-j of the plug connector CNP is in contact with the contact portion 37H of the contact 3H-j of the host connector CNH.

The above is the details of the configuration of the present embodiment, and according to the present embodiment, the following effects can be obtained.

The plug connector CNP of the present embodiment includes: a housing 1P having a long hole 17P-m extending in one direction; and a plurality of terminals arranged in the long hole 17P-m, each of which having contact portions 37P, 47*a*P, 47*b*P, 47*c*P, 47*d*P in contact with the mating connector and soldering terminal portions soldered to a mounting target substrate. Then, among these terminals, the terminals interposed between the shield plate 5H-m of the host connector CNH and the pad of the extension substrate 91 are divided into shield contacts 4P-m which are components having the contact portions 47*a*P, 47*b*P, 47*c*P, 47*d*P and shield plates 5P-m which are components having soldering terminal portions. The first end portion of the shield contact 4P-m on the side opposite to the side of the contact portions 47*a*P, 47*b*P, 47*c*P, 47*d*P and the second end portion of shield plate 5P-m on the side opposite to the side of the soldering terminal portions are pressed into the long hole 17P-m from directions opposite to each other, and the first and second end portions abut on each other in the long hole 17P-m. Thus, by dividing the contact portions 37P, 47*a*P, 47*b*P, 47*c*P, 47*d*P of the shield contact 4P-m and the soldering terminal portions, the opening portion of the long hole 17P-m of the housing 1P can be minimized, and the rigidity of the housing 1P can be ensured. Further, by pressing and fitting the respective components, the same performance as that of the single piece structure can be ensured. Therefore, it is possible to provide a connector for high-speed transmission capable of reducing the width of the opening portion of the housing 1P and ensuring the rigidity of the housing.

Further, the host connector CNH of the present embodiment includes: a housing 1H having a plurality of slots 10H; and a plurality of contacts 3H-j including contacts 3H-j (G) which are ground terminals and contacts 3H-j(S) which are signal terminals, in which the plurality of contacts 3H-j are arranged in the slots 10H along the Y direction as a first direction orthogonal to the fitting direction of the connector. Partition walls 15H-k are provided between the adjacent contacts 3H-j in the slots 10H, and the height of the partition walls 15H-k between the ground contacts 3H-j(G) and the signal contacts 3H-j(S) in the fitting direction is lower than the height of the other partition walls 15H-k in the fitting direction. Thus, an air layer, which is a layer of a space with a smaller dielectric constant than that of a resin partition wall 15H-k is formed between the signal contact 3H-j(S) and the ground contact 3H-j(G). Therefore, it is possible to provide a connector for high-speed transmission capable of reducing the crosstalk between the adjacent channels.

Further, the host connector CNH of the present embodiment includes: a housing 1H; and a plurality of contacts 3H-j having a contact portion 37H in contact with the mating connector and a soldering terminal portion soldered to the mounting target substrate, in which the plurality of contacts 3H-j are arranged in the housing 1H with the contact portion 37H and the soldering terminal portion facing each other. The soldering terminal portion is a fork portion 30H, and a cut piece 300 of a wire solder is sandwiched and crimped in the fork portion 30H. Thus, the heating process of the terminal in the reflow layer, which is required in the conventional solder ball type soldering, can be reduced, and the influence of heat treatment can be reduced. Therefore, it is possible to provide a connector that can reduce the overheating process of the terminal in the reflow and reduce the adverse effect on the finished product due to the heat treatment.

The embodiments of the present invention have been described above, however, the following modifications may be added to these embodiments.

(1) In the above embodiments, there were three slots 10H in the housing 1H of the host connector CNH, and there were three headers 10P in the housing 1P of the plug connector CNP. However, the number of the slots 10H and the headers 10P may be one, two, or four or more.

Figure 24A:
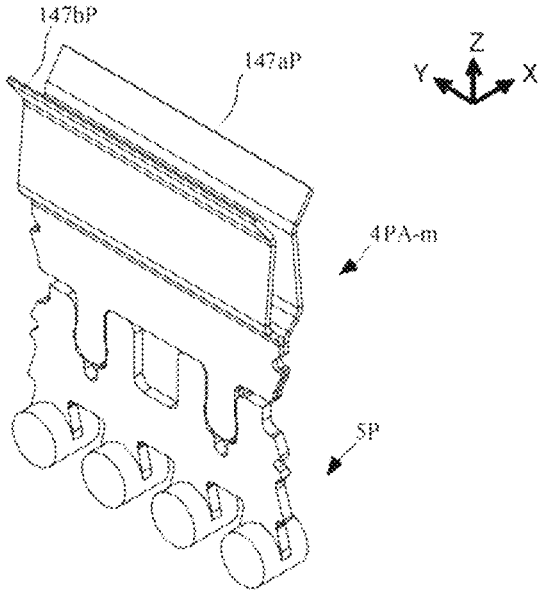
FIG. 24A is a diagram showing shield contacts 4PA-m of a plug connector CNP according to a first modification of the present invention.
Figure 24B:
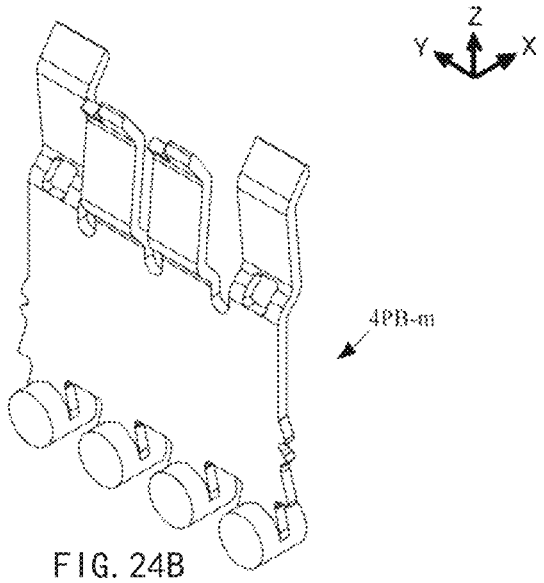
FIG. 24B is a diagram showing shield contacts 4PB-m of a plug connector CNP according to a second modification of the present invention.

(2) In the above embodiment, the contact portions 47*a*P, 47*b*P, 47*c*P, 47*d*P of the shield contact 4P-m of the plug connector CNP were described as being bent and extended in a dogleg shape from four locations at the lower end of the main body portion 41P separated in the Y direction. However, like the shield contact 4PA-m of FIG. 24A, the contact portions 47*a*P, 47*b*P, 47*c*P, 47*d*P may be replaced by contact portions 147*a*P, 147*b*P composed of a pair of plate bodies in which the cross sections viewed from the Y direction are formed in dogleg shapes in directions opposite to each other, and the shield plate 5P-m of the host connector CNH may be inserted between the contact portions 147*a*P and 147*b*P. Furthermore, like the shield contact 4PB-m of FIG. 24B, the terminal of the plug connector CNP to be pressed into the long hole 17P-m of the header 10P may not be divided into the shield contact 4P-m and the shield plate 5P-m, and may be configured by a single plate component having a contact portion and soldering terminal portion.

(3) In the above embodiment, the number of the contacts 3H-j, 3P-j forming a row may be less than two or may be more than two. Further, the number of the shield plates 4H-m, the shield contacts 4P-m, and the shield plates 5P-m may be less than seven or may be more than seven. Moreover, the number of the ribs 14H-k, ribs 14H-k, partition walls 15H-k may be less than twenty-seven or may be larger than twenty-seven.

What is claimed is:

1. A connector for high-speed transmission to be fitted with an external counterpart connector, the connector for high-speed transmission comprising:

a housing with at least one slot;

a plurality of terminals which comprise ground terminals and signal terminals, and are arranged in the slot along a first direction orthogonal to a fitting direction of the connector; and partition walls provided between adjacent terminals in the slot, wherein a height of the partition walls between the ground terminals and the signal terminals in the fitting direction is lower than a height of other partition walls in the fitting direction.

2. The connector for high-speed transmission according to claim 1, wherein upper ends of the partition walls between the ground terminals and upper ends of the partition walls between the signal terminals are located at substantially the same positions as upper surface of the housing, and upper ends of the partition walls between the ground terminals and the signal terminals are below the upper surface of the housing.

3. The connector for high-speed transmission according to claim 1, wherein the terminal comprises a linear portion extending along the fitting direction and a curved portion curved from a tip end of the linear portion toward a side of a second direction orthogonal to the fitting direction and the first direction, and no partition wall separates the curved portion of the ground terminal and the curved portion of the signal terminal, and an air layer is formed between the curved portions.

4. The connector for high-speed transmission according to claim 1, wherein the terminal comprises a linear portion extending along the fitting direction and a curved portion curved from a tip end of the linear portion toward a side of a second direction orthogonal to the fitting direction and the first direction, and the linear portion of the ground terminal and the linear portion of the signal terminal are separated by the partition wall.

5. The connector for high-speed transmission according to claim 1, further comprises:

a plurality of ribs arranged at intervals in the first direction on inner wall surfaces facing each other in the slot, wherein the plurality of terminals are accommodated in gaps between adjacent ribs in the slot one by one in an arrangement order in which two ground terminals and two signal terminals are set as a group and the two signal terminals are interposed between two ground terminals.

6. The connector for high-speed transmission according to claim 5, wherein the terminal comprises a fork portion and a solder is clamped and riveted in the fork portion, and the solder of the terminal is supported by an upper end of the rib.

7. The connector for high-speed transmission according to claim 1, wherein the terminal comprises a contact portion to contact an external counterpart connector, and a portion of the partition wall between the ground terminal and the signal terminal just beside the contact portion is cut out.

8. The connector for high-speed transmission according to claim 5, wherein the slot is provided with a support to support a shield plate as another terminal, and the partition wall is bridged between the rib and the support.

9. The connector for high-speed transmission according to claim 8, wherein a long hole is bored in the support, and the shield plate is pressed into the long hole.

10. A connector for high-speed transmission, comprising:

a housing with a long hole extending in one direction; and a plurality of terminals arranged in the long hole, each of which comprises a contact portion to contact an external counterpart connector and a soldering terminal portion to be soldered to an external mounting target substrate, wherein the terminals are divided into a shield contact which is a component comprising the contact portion, and a shield plate which is a component comprising the soldering terminal portion, and wherein a first end portion of the shield contact on an opposite side of the contact portion and a second end portion of the shield plate on an opposite side of the soldering terminal portion are pressed into the long hole from directions opposite to each other, and the first and second end portions abut on each other in the long hole.

11. The connector for high-speed transmission according to claim 10, wherein the soldering terminal portion is a fork portion bifurcated and extending from a main body of the terminal, and solder is sandwiched and crimped in the fork portion.

12. The connector for high-speed transmission according to claim 10, further comprising a locking piece is bridged between inner wall surfaces of the long hole facing each other, thereby positioning the shield contact and the shield plate.

13. The connector for high-speed transmission according to claim 12, wherein the shield contact comprises a first main body portion and a plurality of first convex portions protruding from a plurality of locations at one end of the first main body portion, the shield plate comprises a second main body portion and a plurality of second convex portions protruding from a plurality of locations at one end of the second main body portion, wherein the locking piece is fitted between the plurality of first convex portions, and the plurality of first convex portions are fitted between the plurality of second convex portions.

14. The connector for high-speed transmission according to claim 10, wherein the contact portion is bent and extends from a plurality of locations at one end of the main body portion of the terminal, and of a plurality of the contact portions, bending orientations of the contact portion on an inner side and the contact portion on an outer side in the arrangement direction of the contact portions are reversed.

15. The connector for high-speed transmission according to claim 14, wherein an upper end of the contact portion on the outer side and an upper end of the contact portion on the inner side are inclined in directions away from each other.

16. The connector for high-speed transmission according to claim 10, wherein a plurality of notches are provided in inner wall surfaces of the long hole facing each other, a third convex portion is formed on a side surface of the shield contact, a fourth convex portion is formed on a side surface of the shield plate, and the third convex portion and the fourth convex portion are engaged with the notches to prevent the shield contact and the shield plate from coming off.

17. A contact for high-speed transmission, comprising:

a housing; and a plurality of terminals comprising contact portions in contact with a counterpart connector and soldering terminal portions soldered to a mounting target substrate in which the contact portions and the soldering terminal portions are arranged in the housing so as to face each other, wherein the soldering terminal portion is a fork portion, and a cut piece of a wire solder is sandwiched in the fork portion, the terminal comprises:

a first linear portion and a second linear portion extending along a fitting direction with the counterpart contact;

a first curved portion curved from an end portion of the first linear portion opposite to the fork portion toward the second linear portion side and connected to one end of the second linear portion;

a second curved portion curved from other end of the second linear portion to a side opposite to the first linear portion;

an inclined portion extending slightly inclined from an end portion of the second curved portion toward a side away from the second linear portion; and a contact portion bending and extending from a tip end of the inclined portion, the contact portion is further inclined and extends from the base end connected to the inclined portion toward a side opposite to the second linear portion, and then bends and extends in a dogleg shape, the tip end of the contact portion faces the first curved portion, a width of the contact portion in a direction orthogonal to the fitting direction is narrowed at the base end of the contact portion, and wherein a width of the tip end of the contact portion in the direction orthogonal to the fitting direction is approximately half of a width of the base end of the contact portion in the direction orthogonal to the fitting direction.

18. The contact for high-speed transmission according to claim 17, wherein solder spreads up to a surface on an outer side of the fork portion, and a part of an outer surface of the fork portion is covered by the solder.

19. The contact for high-speed transmission according to claim 18, wherein in the housing, the solder fixed to the fork portion faces upward, the contact portion faces downward, and the solder fixed to the fork portion is exposed on an upper side of an upper surface of the housing.

20. The contact for high-speed transmission according to claim 17, wherein a convex portion protruding in the direction orthogonal to the fitting direction is formed on a side surface of the first linear portion.

21. A solder fixing method for fixing solder to a fork portion of the contact for high speed transmission according to claim 17, the method comprising:

a first step of pushing the cut piece into the fork portion, the cut piece being obtained by cutting a wire solder into a piece longer than the width of the fork portion; and a second step of sandwiching the cut piece of the wire solder with a tool and crimping the cut piece to the fork portion.

* * * * *